US007957680B2

(12) United States Patent
Sato

(10) Patent No.: US 7,957,680 B2
(45) Date of Patent: Jun. 7, 2011

(54) TONER CARTRIDGE

(75) Inventor: Tsutomu Sato, Izunokuni (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 435 days.

(21) Appl. No.: 11/749,280

(22) Filed: May 16, 2007

(65) Prior Publication Data

US 2007/0269238 A1 Nov. 22, 2007

(30) Foreign Application Priority Data

May 18, 2006 (JP) ..... 2006-139192

(51) Int. Cl.
*G03G 15/08* (2006.01)
*B01F 7/02* (2006.01)

(52) U.S. Cl. ..... 399/263; 366/309; 399/256

(58) Field of Classification Search ..... 399/263, 399/256, 254; 366/309, 311, 312
See application file for complete search history.

(56) References Cited

U.S. PATENT DOCUMENTS

| | | | | | |
|---|---|---|---|---|---|
| 1,122,735 | A | * | 12/1914 | Grant | 366/311 |
| 1,430,070 | A | * | 9/1922 | Franzwa | 366/312 |
| 1,862,412 | A | * | 6/1932 | MacLellan | 366/312 |
| 2,109,077 | A | * | 2/1938 | Straight | 366/309 |
| 4,571,091 | A | * | 2/1986 | Pardo et al. | 366/311 |
| 5,124,752 | A | * | 6/1992 | Kanno et al. | 399/256 |
| 5,202,732 | A | * | 4/1993 | Yahata | 399/263 |
| 5,220,382 | A | * | 6/1993 | Hediger | 399/256 |
| 5,243,390 | A | * | 9/1993 | Takemoto et al. | 399/254 |
| 5,835,827 | A | * | 11/1998 | Kishimoto | 399/254 |
| 5,842,093 | A | * | 11/1998 | Tanda | 399/263 |
| 5,848,342 | A | * | 12/1998 | Tanda | |
| 5,884,130 | A | * | 3/1999 | Tsutsumi et al. | 399/254 |
| 6,229,976 | B1 | * | 5/2001 | Kimura | 399/263 |
| 6,337,956 | B1 | * | 1/2002 | Sato et al. | 399/254 |
| RE37,542 | E | * | 2/2002 | Ichikawa et al. | 399/263 |
| 6,421,517 | B1 | * | 7/2002 | Nishino et al. | 399/254 |
| 7,139,516 | B2 | * | 11/2006 | Makino | 399/256 |
| 2001/0046395 | A1 | * | 11/2001 | Ashikari et al. | 399/262 |
| 2005/0002698 | A1 | * | 1/2005 | Jeon | 399/254 |
| 2007/0269238 | A1 | * | 11/2007 | Sato | 399/263 |

FOREIGN PATENT DOCUMENTS

| | | | |
|---|---|---|---|
| JP | 10-282774 | | 10/1998 |
| JP | 10319701 | A * | 12/1998 |
| JP | 2004191436 | A * | 7/2004 |
| JP | 2005134725 | A * | 5/2005 |
| JP | 2006098491 | A * | 4/2006 |

* cited by examiner

*Primary Examiner* — Susan S Lee
(74) *Attorney, Agent, or Firm* — Turocy & Watson, LLP

(57) ABSTRACT

A toner cartridge inserted in an image forming apparatus and supplying toner to the image forming apparatus comprises a container which contains the toner and provided with a discharging opening for discharging the contained toner, the container having a shape with a predetermined curvature at a bottom part, a conveying member which conveys the toner in the container to the discharging opening, an agitating member which rotates centering on a rotational axis in the container, and agitates the toner contained in the container and a sheet member provided in the agitating member such that a front edge part abuts the bottom part of the container, the sheet member having the front edge part which is formed with a part having substantially the same curvature as the bottom part of the container.

12 Claims, 8 Drawing Sheets

TONER CARTRIDGE

CROSS-REFERENCE TO RELATED APPLICATIONS

This application is based upon and claims the benefit of priority from prior Japanese Patent Application No. 2006-139192, filed May 18, 2006, the entire contents of which are incorporated herein by reference.

BACKGROUND OF THE INVENTION

1. Field of the Invention

The present invention relates to a toner cartridge for supplying toner to an image forming apparatus.

2. Description of the Related Art

As a conventional toner cartridge, there is one which has a container in which a discharging opening for housing toner and discharging the toner inside is provided, and a mixer journaled in the container in a rotatable manner and conveys the toner contained in a container along an inner wall while agitating the toner by rotational drive and sends out the tone from the discharging opening. A screw is configured such that an outer periphery part of the screw is arranged at a position close to the inner wall of the container.

However, in the conventional toner cartridge described above, a gap is formed between the mixer and the inner wall of the container. Therefore, the toner accumulates in the gap between the mixer and the inner wall of the container as a remaining amount of the toner in the container becomes little. This leads to a problem that the accumulated toner cannot be discharged.

In order to resolve the above problem, there is a toner cartridge including: a container which contains the toner and provided with a discharging opening for discharging the contained toner; and a agitating member which is connected to a rotational axis journaled in the container and is for sending out the toner from a sending out opening by conveying the toner along an inner wall while agitating the toner contained in the container by the rotational axis rotationally driving, wherein the agitating member includes a base part having a predetermined elastic deformation on a side of the rotational axis and a conveying member which is arranged outside the base part in a radial direction, rubs the inner wall of the container, and has a front edge part having larger elastic deformation than the base part (for example, refer to Jpn. Pat. Appln. Publication No. 10-282774).

However, in this case, when the front edge part of the conveying member rubs the inner wall of the container, stress is applied to the toner accumulated on the inner wall by sliding friction between the front edge part and the container. Thereby, there is a case that the properties of the toner changes and clumps (so-called coarse powder) are generated. Such generation of clumps has led to generation of a clump image on a printing surface of paper, and been an interference in improving image quality in an image forming processing.

The present invention is invented in order to solve the above problem. An object of the present invention is to provide a toner cartridge capable of preventing the toner from remaining at a bottom part of the toner container in the toner cartridge inserted in the image forming apparatus, and thereby, contributing to improvement of image quality in an image forming processing.

BRIEF SUMMARY OF THE INVENTION

According to one aspect of the present invention, there is provided a toner cartridge comprising: a container which contains the toner and provided with a discharging opening for discharging the contained toner, the container having a shape with a predetermined curvature at a bottom part, a conveying member which conveys the toner in the container to the discharging opening, an agitating member which rotates centering on a rotational axis in the container, and agitates the toner contained in the container and a sheet member provided in the agitating member such that a front edge part abuts the bottom part of the container, the sheet member having the front edge part which is formed with a part having substantially the same curvature as the bottom part of the container.

DETAILED DESCRIPTION OF THE INVENTION

Hereinafter, a preferred embodiment for carrying out the present invention will be described.

Figure 1:
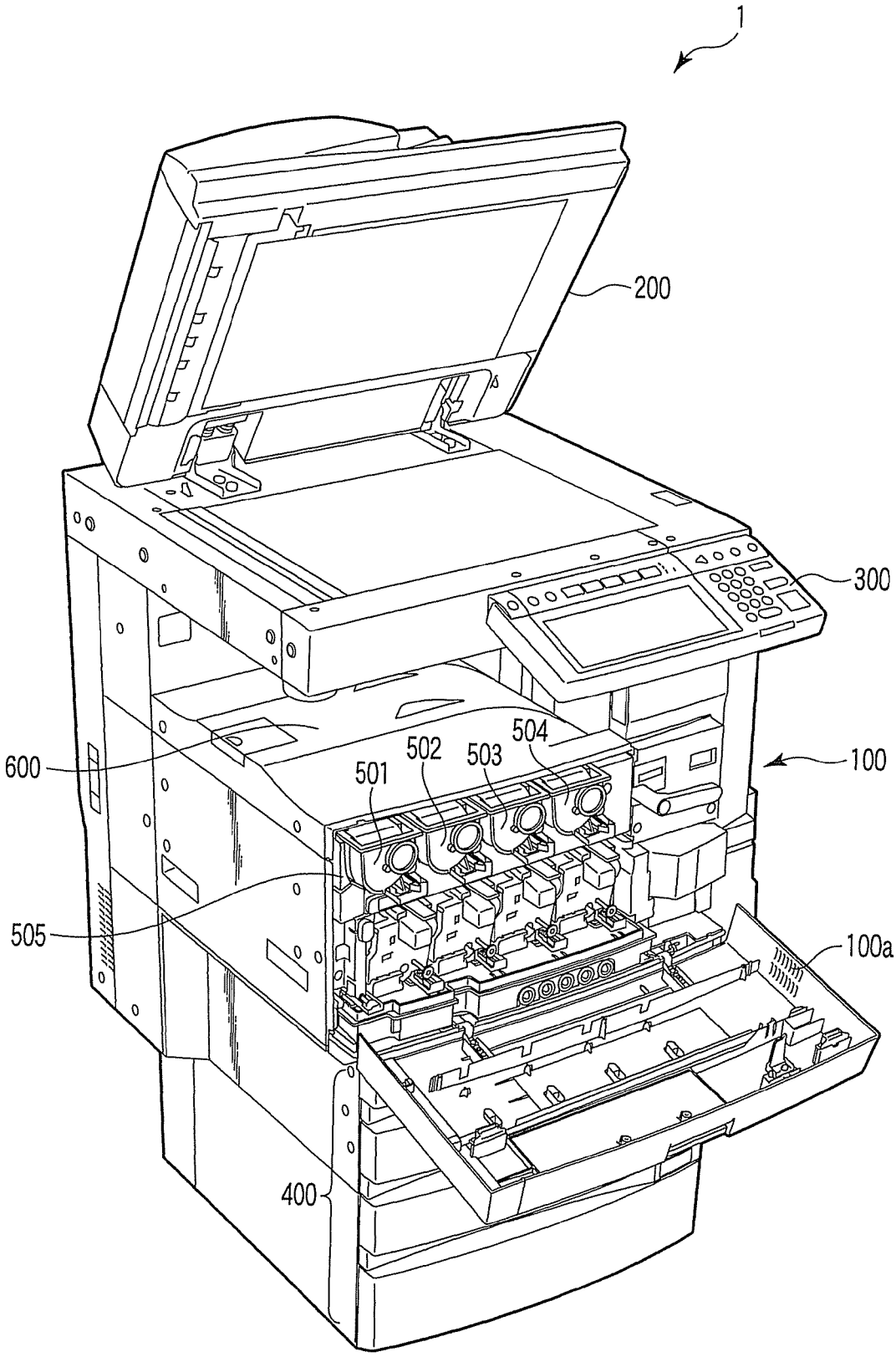
FIG. 1 is a schematic view showing an internal structure of an image forming apparatus according to one embodiment of the present invention.

FIG. 1 is a perspective view of a schematic view showing an internal structure of an image forming apparatus 1 according to an embodiment of the present invention. As shown in FIG. 1, the image forming apparatus 1 is a color copier of a quadruple tandem system. The image forming apparatus 1 includes a copier main body 100, a platen cover 200, a control panel 300, and a plurality of paper feeding cassettes 400.

The copier main body 100 plays a major role in image forming, and has a cover 100*a* provided on a front surface thereof in an openable and closable manner. When the cover 100*a* is opened, first to fourth toner cartridges 501 to 504 are found to be arranged in alignment on an upper portion side of the cover 100*a*. The platen cover 200 is provided on the copier main body 100 in an rotatable manner with one side edge as a rotational center. The control panel 300 is an input unit for copy operation and is provided on a top surface of the copier main body 100. The paper feeding cassette 400 is for containing paper and is provided on a lower side of the copier main body 100 in a removable manner. In addition, a paper delivering unit 600 is provided on top of a portion where the first to fourth toner cartridges 501 to 504 are provided.

Each of the first to fourth toner cartridges 501 to 504 is provided in a removable manner in a cartridge holding mechanism 505. The first to fourth toner cartridges 501 to 504 are for supplying toner of yellow, magenta, cyan, and black.

Next, a configuration of the first toner cartridge 501 will be described with reference to FIG. 2. Description of configurations of the second to fourth toner cartridges 502 to 504 will be omitted, since such configurations are almost same as the configuration of the first toner cartridge 501.

Figure 2:
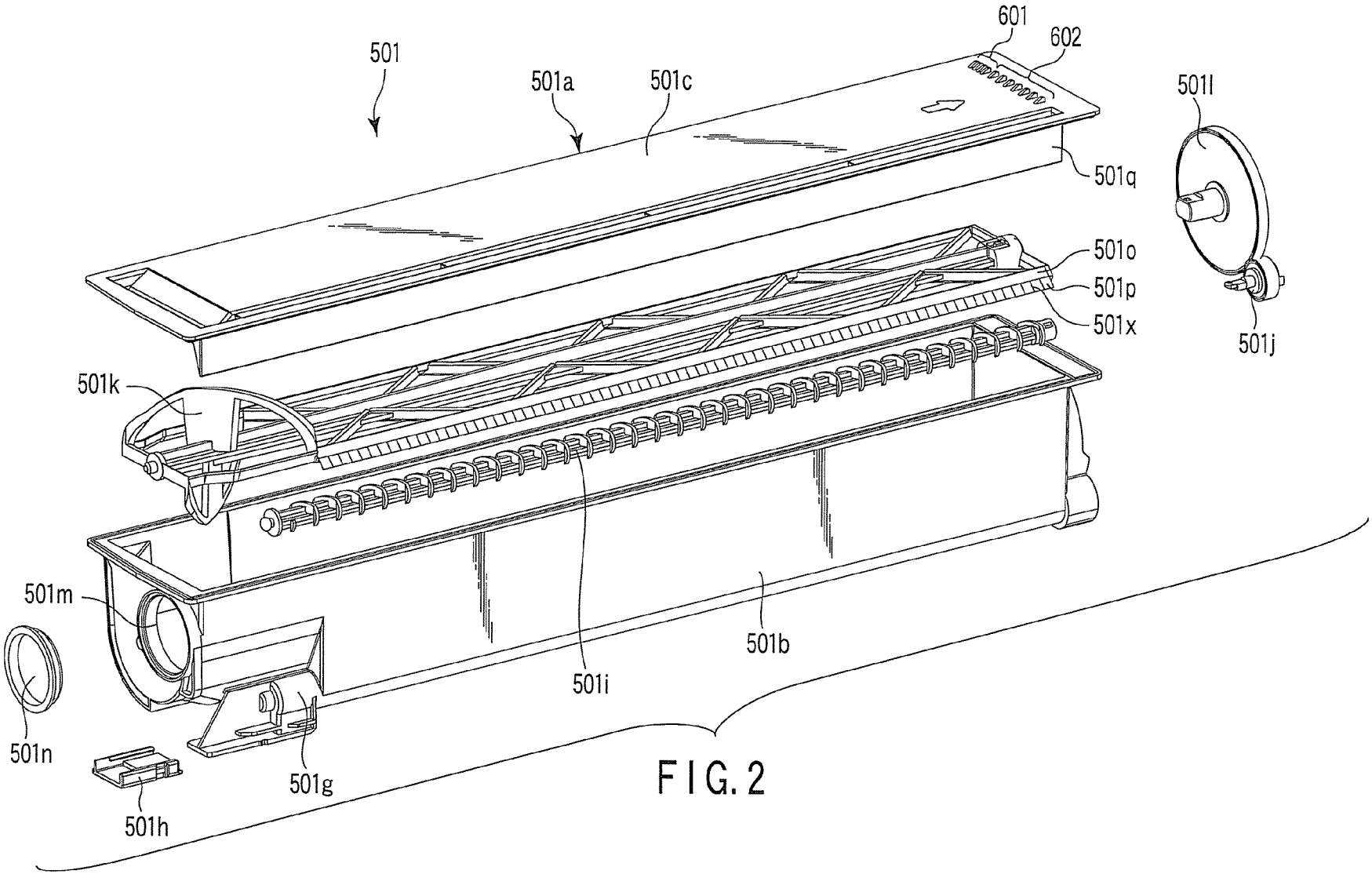
FIG. 2 is a perspective view showing a toner cartridge according to the present embodiment viewed from above a front side.

FIG. 2 is a perspective view showing an entire configuration of the first toner cartridge 501 according to the present embodiment viewed from a front surface side. Here, a surface with a cap 501*n* of the first toner cartridge 501 is the front surface side, and a surface with a mixer gear 501*l* as an agitating member is a rear side.

As shown in FIG. 2, the first toner cartridge 501 includes a cartridge main body 501*a* working as a toner container for containing the toner. The cartridge main body 501*a* is configured with a container body 501*b* and a lid body 501*c*. Also, first and second discriminating protrusion units 601 and 602 for discriminating toner information are provided on a rear side of the cartridge main body 501*a*.

The container body 501*b* has a U-shaped cross section. The lid body 501*c* has a rectangular plate shape. On a front surface side of the container body 501*b*, there is provided a discharging unit 501*g* which discharges the toner in the cartridge main body 501*a* and works as a toner supplying opening for supplying the toner in the image forming apparatus 1. The discharging unit 501*g* projects downwardly from a bottom surface of the container body 501*b*. On a bottom edge part of the discharging unit 501*g*, there is provided a shutter 501*h* for opening and closing a discharging opening (not shown) formed on the discharging unit 501*g*.

Figure 6:
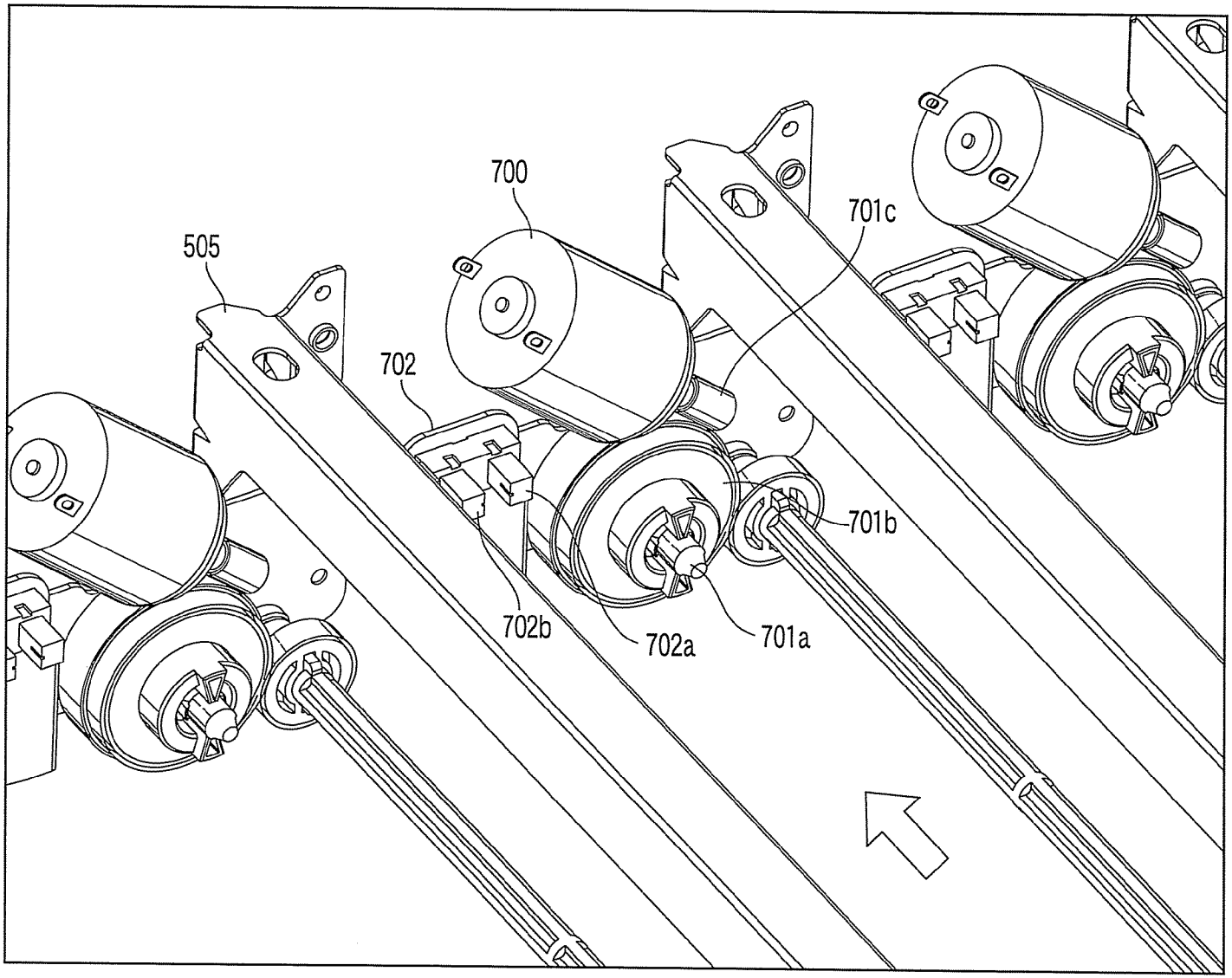
FIG. 6 is a perspective view of an inside of the image forming apparatus according to the present embodiment viewed from above a front side.

At the inner bottom of the containing unit 501*b*, there is provided a screw 501*i* working as a conveying member for conveying the toner in the cartridge main body 501*a* to the discharging unit 501*g*. On an end part on a rear surface side of the screw 501*i*, there is provided a coupling member 501*j* working as a driving member. The coupling member 501*j* is connected to a driving apparatus 700 shown in FIG. 6 provided in the copier main body 100, and rotationally driven every time the toner is supplied.

Inside the cartridge main body 501*a*, there is provided a mixer 501*k* for agitating the toner in the cartridge main body 501*a*. At an end part on a rear surface of the mixer 501*k*, there is provided a mixer gear 501*l*. The mixer gear 501*l* meshes with the coupling member 501*j* working as a gear provided in the screw 501*i*. When the screw 501*i* is rotated, the mixer gear 501*k* is configured to rotate in association therewith.

On a front surface side of the container body 501*b*, there is formed a filling opening 501*m* used for filling the toner in the cartridge main body 501*a*. The filling opening 501*m* has a circular shape, and is sealed with the cap 501*n*.

Figure 3:
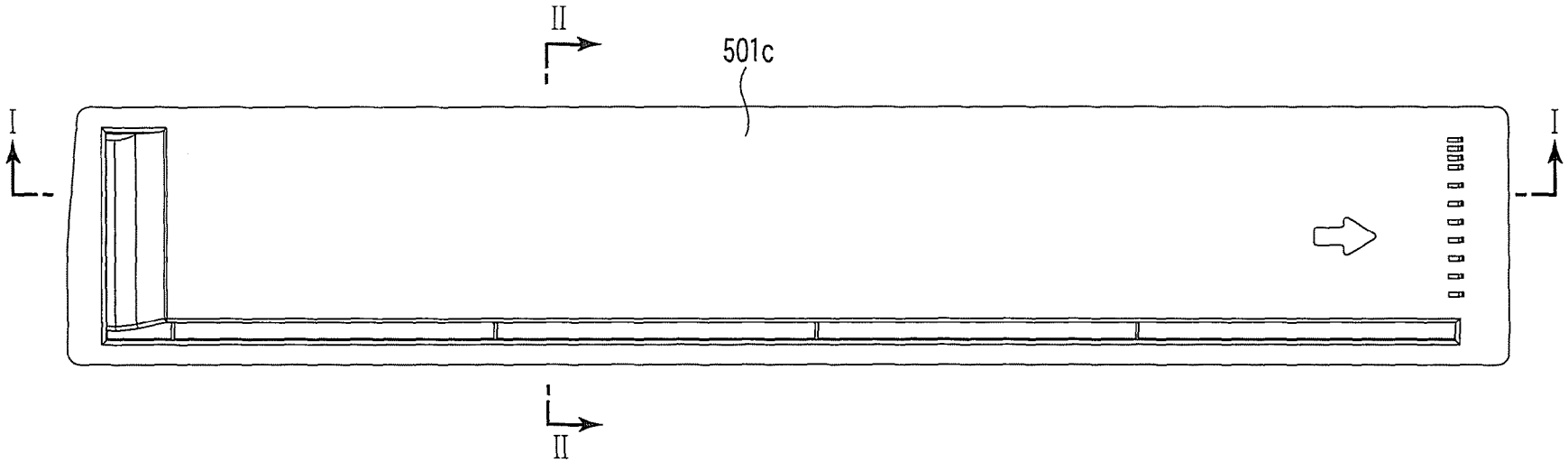
FIG. 3 is a plan view showing the toner cartridge according to the present embodiment viewed from above.
Figure 4:
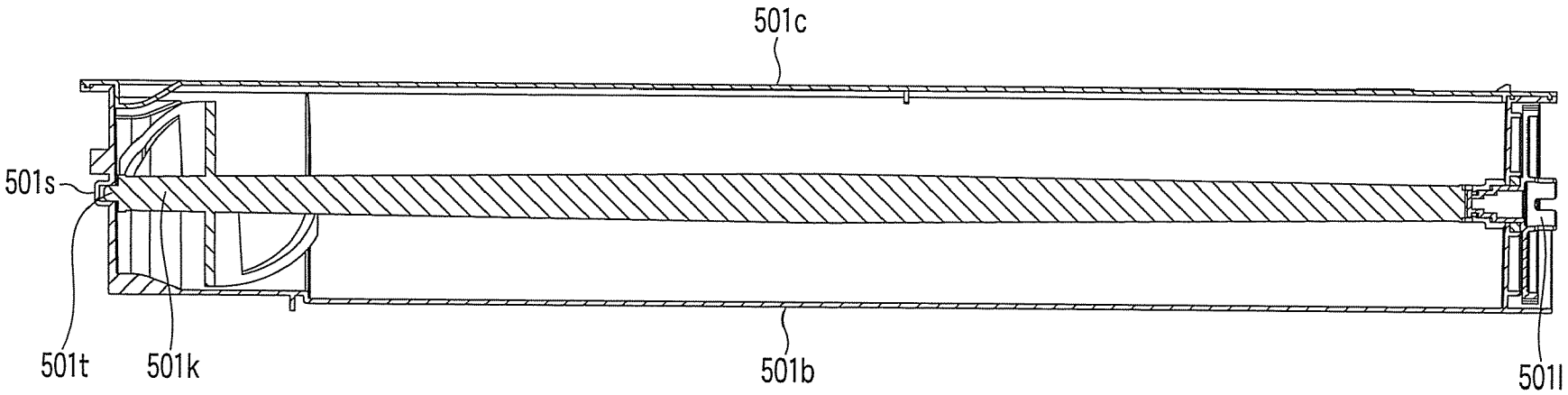
FIG. 4 is a transverse cross-sectional view showing an internal structure of the toner cartridge according to the present embodiment.

FIG. 3 is a view of the first toner cartridge 501 viewed from above a top surface. In addition, FIG. 4 shows a cross-sectional view of the first toner cartridge 501 cut along the line I-I in FIG. 3. The mixer 501*k* is fixed as described below. On a rear side surface of the first toner cartridge 501, the mixer 501*k* connects with the mixer gear 501*l* with a coupling unit interposed therebetween. In addition, on a front surface side of the first toner cartridge 501, the mixer 501*k* has a convex part 501*t* formed in a convex shape at an end part, and fits in a concave part 501*s* provided on a front surface side of the container body.

Here, an inner diameter of the concave part 501*s* is little larger than an outer diameter of the convex part 501*t*. For this reason, when the mixer 501*k* rotates to agitate the toner, the toner enters into a little gap between the convex part 501*t* and the concave part 501*s*. In this manner, friction between the convex part 501*t* and the concave part 501*s* is reduced, and the mixer 501*k* can rotate smoothly.

Figure 5A:
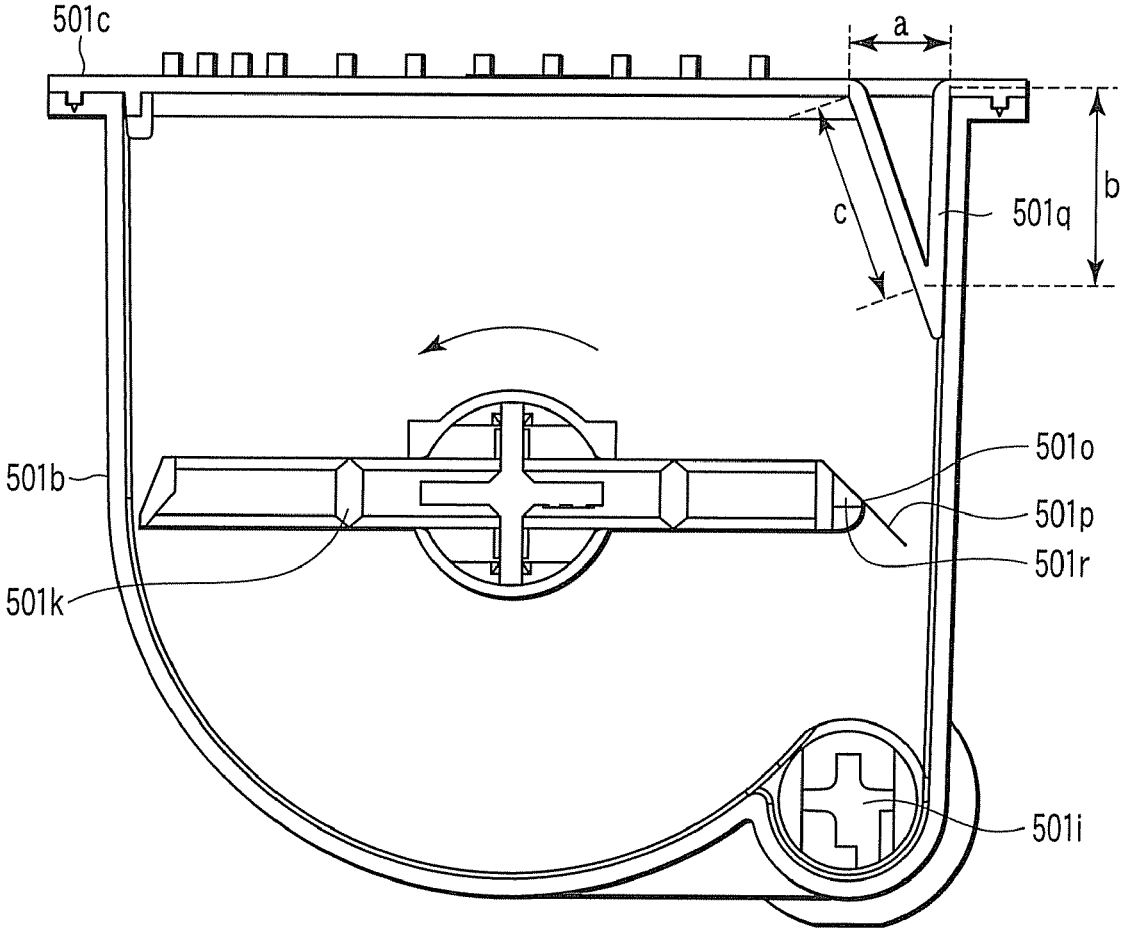
FIG. 5A is a vertical cross-sectional view showing the internal structure of the toner cartridge according to the present embodiment.

FIG. 5A shows a cross-sectional view of the first toner cartridge 501 cut along the line II-II in FIG. 3. The lid body 501*c* has a lid body protrusion part 501*q*. The lid body protrusion part 501*q* is provided at an upper edge of the container body 501*b* when the lid body 501*c* is inserted in the container body 501*b*. The lid body protrusion part 501*q* is a protrusion having a cross-sectional triangle shape enclosed by a line a, a line b, and an oblique line c. The line a has a predetermined length in a width direction from a connection of the lid body 501*c* and the container body 501*b*. The line b has a predetermined length from the connection of the lid body 501*c* and the container body 501*b* to the container body 501*b* and crosses the line a at a substantial right angle. The oblique line c is determined by the above two sides.

In addition, a surface enclosed by the line b having a predetermined length of the lid body protrusion part 501*q* and a longitudinal direction of the lid body 501*c* is formed such that the lid body 501*c* abuts the container body 501*b* without having any gap interposed therebetween when the lid body 501*c* is inserted in the container body 501*b*.

When the amount of the toner in the toner cartridge main body 501*a* becomes little, a gap appears between an outer periphery of the mixer 501*k* and an inner wall of the container body 501*b*. Therefore, the toner remaining in the gap cannot be conveyed by the mixer 501*k*. However, in the present embodiment, the lid body protrusion part 501*q* fills the gap appearing in the connection of the container body 501*b* and the lid body 501*c*. Therefore, the toner can be prevented from remaining in the gap.

Further, the lid body protrusion part 501*q* is provided with a surface having the oblique line c. Therefore, the toner adhered to the lid body protrusion part 501*q* easily flows down to an inside bottom of the container body 501*b*, and adherence of the toner hardly occurs.

In addition, as shown in FIG. 5A, a sweep sheet 501*o* is fixed on a mounting surface 501*r* which is an outer periphery part of the mixer 501*k*. In addition, a sweep part 501*p*, which is a free end not fixed on the mounting surface 501*r* of the sweep sheet 501*o*, projects in a further extended direction from an outer periphery part of the mixer 501*k*. The mixer 501*k* rotates counterclockwise in FIG. 5A which is a cross-sectional view of the first toner cartridge 501 viewed from a front surface side. For this reason, the sweep part 501*p* abuts the inner bottom of the container body 501*b*.

Further, as shown in FIG. 2, the sweep sheet 501*o* is inserted on the mounting surface 501*r* of the mixer 501*k* over a longitudinal direction. In addition, a plurality of cut parts 501*x* shown in FIG. 2 are formed on the sweep sheet 501*o* in a direction substantially parallel to a rotational axis with predetermined intervals, here intervals of 5 mm, over a whole length in a width direction. For this reason, divided parts of the sweep sheet 501*o* can change elasticity independently.

As shown in FIG. 5A, the sweep sheet 501*o* is affixed to the mounting surface 501*r* of an outside edge part of the mixer 501*k* in a rotational radial direction in an angle inclined at around 45 degrees from a rotational radial direction to a rotational radial rear side of the mixer 501*k* on a flat surface which crosses the rotational axis of the mixer 501*k* at substantial right angle. The sweep sheet 501*o* is inserted on the mounting surface 501*r* with a double-faced tape, etc. on one end of the sweep sheet 501*o*. The sweep sheet 501*o* is a band-shaped PET sheet having a thickness dimension of around 0.05 mm which can be elastically changed.

When a driving force is transmitted from the driving apparatus 700 shown in FIG. 6 to rotationally drive the coupling member 501*j*, the screw 501*i* is rotationally driven in an integrated manner, and the mixer 501*k* is rotationally driven via the mixer gear 501*l*. In this manner, the mixer 501*k* agitates and sends out the toner to the screw 501*i* at the same time. The screw 501*i* conveys the sent-out toner to the discharging unit 501*g*. Then, the toner is discharged from the discharging unit 501*g*. When the first toner cartridge 501 just starts to be used, the toner amount in the container body 501*b* is large. Even when the mixer 501*k* and the sweep sheet 501*o* rotate in an integrated manner, the toner in contact with the sweep part 501*p* passes through the cut parts 501*x* and flows toward a rear direction of the sweep part 501*p*. Therefore, the sweep sheet 501*o* never interferes with the rotation of the mixer 501*k*.

In addition, when the toner amount of the first toner cartridge 501 becomes small, a gap is formed between the outer periphery part of the mixer 501*k* and the inner wall of the container body 501*b*. Therefore, the toner remaining in the gap cannot be conveyed by the mixer 501*k*. However, the sweep sheet 501*o* abuts the inner bottom of the container body 501*b*. Therefore, the toner remaining in the gap can be sent out to the screw 501*i*. In this way, an amount of the remaining toner in the first toner cartridge 501 can be reduced.

Figure 7:
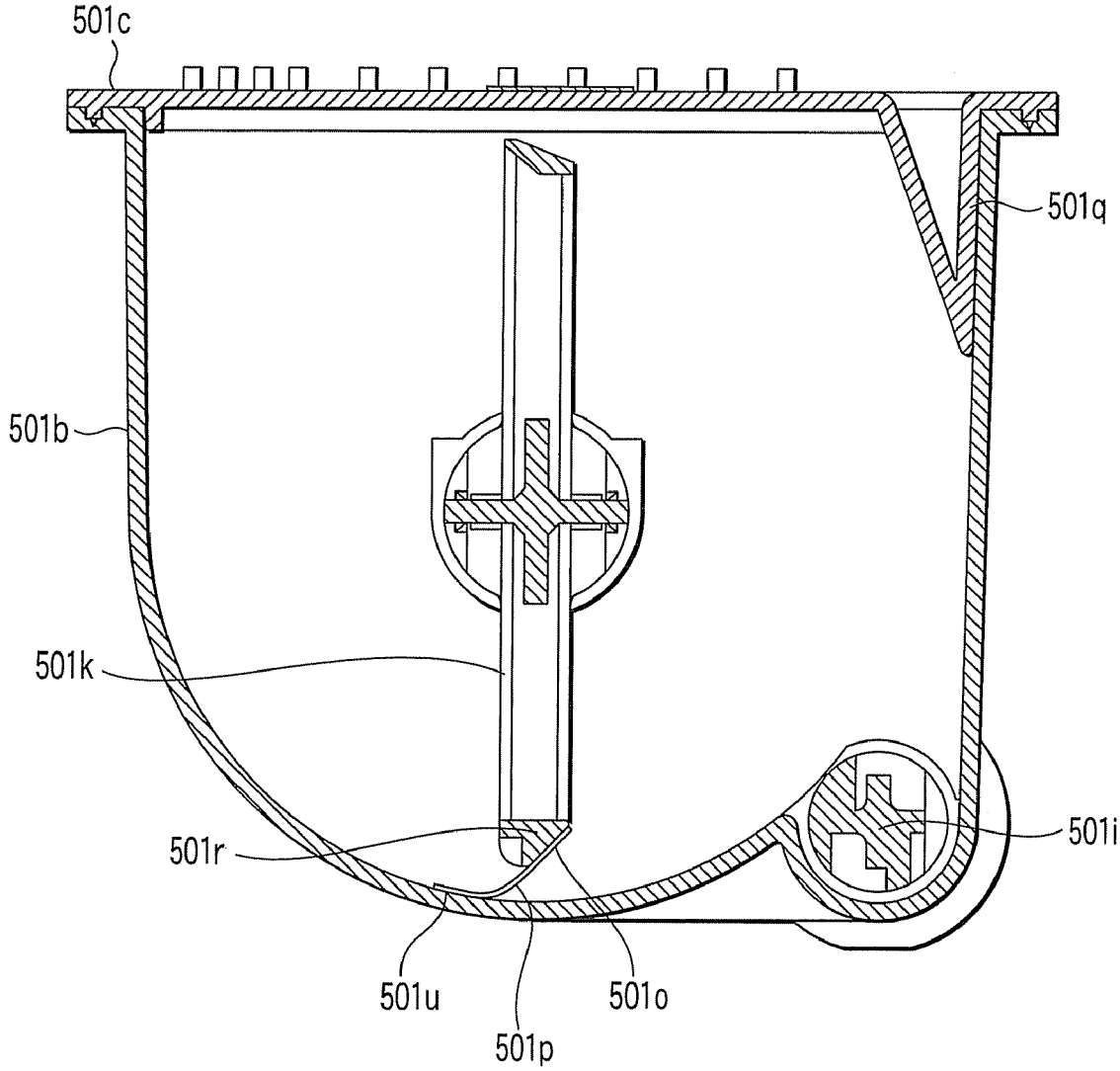
FIG. 7 is an enlarged vertical cross-sectional view showing an inside configuration of the toner cartridge according to the present embodiment.

Next, a shape of the sweep sheet 501*o* which is an important part of the present embodiment will be described. FIG. 7 shows a cross-sectional view of the toner cartridge 501 cut along the line II-II in FIG. 3. Here, in the sweep sheet 501*o* which is a free edge not fixed on the mounting surface 501*r*, a part abutting a bottom part of the container 501*b* of the sweep part 501*p* is particularly considered as a front edge part 501*u*.

FIG. 7 is a view in which the front edge part 501*u* of the sweep sheet 501*o* abuts the bottom part of the container 501*b*. As to a cross-sectional shape of the front edge part 501*u*, an outside edge of the front edge part 501*u* abutting the bottom part of the container 501*b* is formed in the same curvature as, for example, the bottom part of the container 501*b* in advance. In the present embodiment, the bottom part of the container 501*b* of the first toner cartridge 501 is formed with a radius of around 33 mm. For this reason, the front edge part 501*u* of the sweep sheet 501*o* is also formed with substantially the same curvature as the bottom part of the container 501*b*. In addition, a length dimension of the front edge part 501*u* of the sweep sheet 501*o* which abuts an inner wall having a semi-cylindrical shape at the bottom part of the container 501 of the first toner cartridge 501 is preferably 1.1 mm. In order to fix the front edge part 501*u* to this dimension, a length dimension of the sweep part 501*p* is set at 5.4 mm.

That is, the mixer 501*k* rotates, and together therewith, the sweep sheet 501*o* and the front edge part 501*p* also rotates counterclockwise. The front edge part 501*u* is formed so as to just smoothly abutting the bottom part of the container 501*b*. For this reason, even if the front edge part 501*u* rotates for one complete revolution centering on an axis of the mixer 501*k* in association with a rotation of the mixer 501*k*, the front edge part 501*p* only abuts the bottom part of the container 501*b* without pressing hard. Therefore, the front edge part 501*p* is never elastically changed by abutting the container 501*b* and the lid body 501*c*. In addition, the front edge part 501*p* is formed with substantially the same curvature as the bottom part of the container 501*b* in advance. Therefore, when a sheet without curvature is used, the sweep sheet 501*o* never abuts the bottom part of the container 501*b* in such a way as striking the bottom part. Also, unnecessary vibration is never applied to the first cartridge 501 in association with a rotation of the sweep sheet 501*o*.

Therefore, by having the above-described shape, the front edge part 501*u* never generates friction with the container 501*b* when the mixer 501*k* rotates. Also, the front edge part 501*u* never resist the rotation of the mixer 501*k*. In addition, since the front edge part 501*u* does not generate friction with the container 501*b*, the properties of the toner can be prevented from changing when the front edge part 501*u* sweeps out the toner. For this reason, generation of clumps can be prevented, and generation of a clump image on a printing surface of paper is also prevented. Thereby, image quality in the image forming processing can be improved.

Figure 5B:
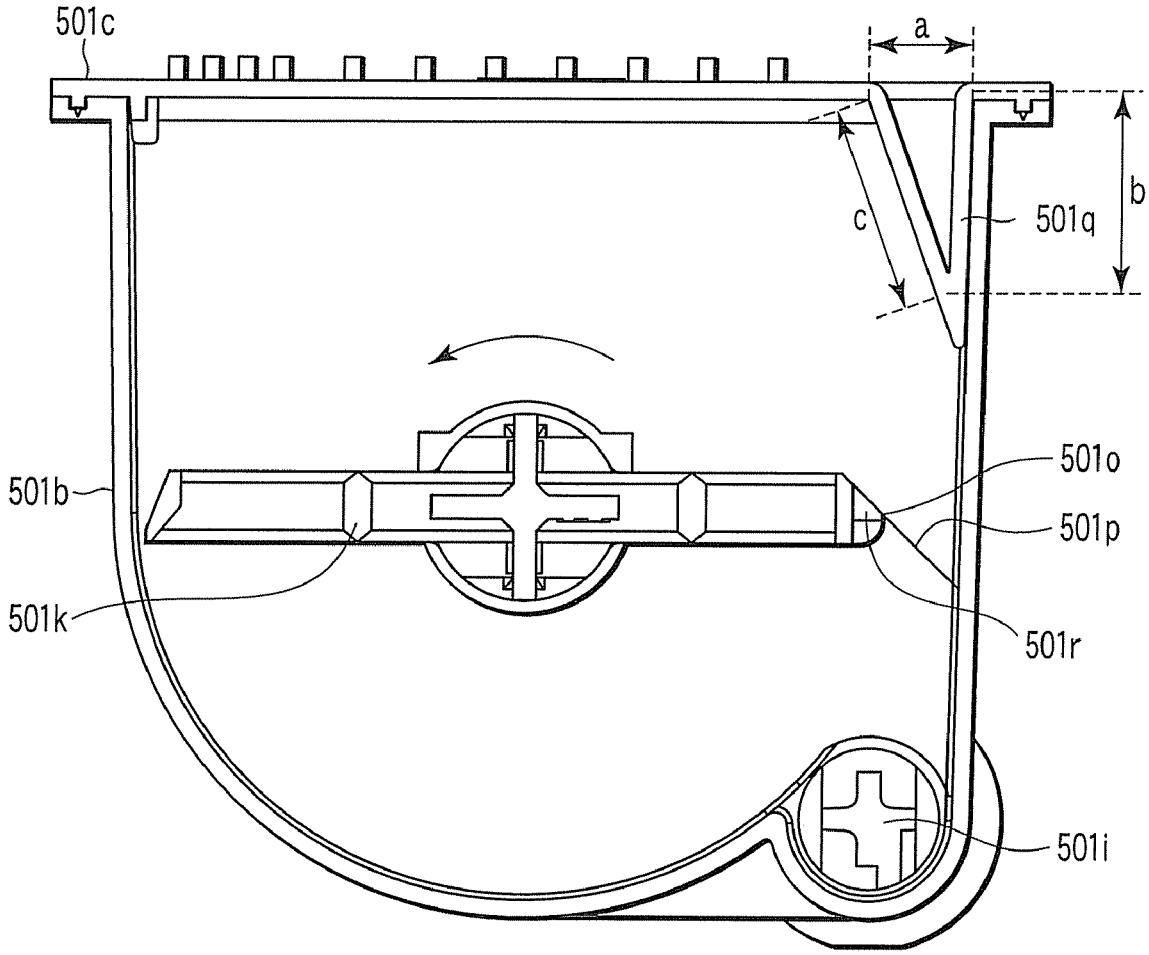
FIG. 5B is a vertical cross-sectional view showing the internal structure of the toner cartridge according to the another embodiment.

In this case in the example shown in FIG. 5A, the length of the sweep part 501*p* is 5.4 mm. As a modified example, an example in which the length is changed to 10 mm will be explained, with reference to FIG. 5B. The sweep part 501*p* abuts an inner right side of the container body 501*b*, viewed from the front surface side of the toner cartridge 501, in addition to the inner bottom of the container body 501*b*. The sweep part 501*p* can brush the toner adhered to the inner right side of the container body 501*b*, because the sweep part 501*p* abuts the inner right side of the container body 501*b*. By increasing the sweep part 501*p* in length, the amount of remaining toner in the cartridge body 501*b* can be further decreased.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A toner cartridge comprising:

a container which contains the toner and provided with a discharging opening for discharging the contained toner, the container having a shape with a predetermined curvature at a bottom part;

a conveying member which conveys the toner in the container to the discharging opening;

an agitating member which rotates centering on a rotational axis in the container, and agitates the toner contained in the container; and a sheet member which is provided on the agitating member and projects in an extended direction from an outer periphery part of the agitating member and has a plurality of cut parts in a direction with intervals in a longitudinal direction, the sheet member having a front edge part which is inclined in an opposite direction with respect to a rotational direction of the agitating member and formed with a part having substantially the same curvature as the bottom part of the container by itself.

2. The toner cartridge according to claim 1, wherein the sheet member abuts at least one of either the bottom part of the container or a side part of the container.

3. The toner cartridge according to claim 2, wherein the sheet member elastically changes.

4. The toner cartridge according to claim 3, wherein the container has a slant face that is formed from an upper part of the container to the side part of the container body along a longitudinal direction of the container as the slant face covers a joint of the upper part of the container and the side part of the container.

5. A toner cartridge comprising:

a contain means for containing the toner and provided with a discharge means for discharging the contained toner, the contain means having a shape with a predetermined curvature at a bottom part;

a convey means for conveying the toner in the contain means to the discharge means;

an agitate means for rotating centering on a rotational axis in the contain means, and agitating the toner contained in the contain means; and an abut means for abutting the bottom part of the contain means, wherein the abut means is provided on the agitate means and projects in an extended direction from an outer periphery part of the agitate means and has a plurality of cut parts in a direction with intervals in a longitudinal direction, the abut means having a front edge part which is inclined in an opposite direction with respect to a rotational direction of the agitate means and formed with a part having substantially the same curvature as the bottom part of the contain means by itself.

6. The toner cartridge according to claim 5, wherein the abut means abuts at least one of either the bottom part of the contain means or a side part of the contain means.

7. The toner cartridge according to claim 6, wherein the abut means elastically changes.

8. The toner cartridge according to claim 7, wherein the contain means has a slant face that is formed from an upper part of the contain means to the side part of the contain means along a longitudinal direction of the contain means as the slant face covers a joint of the upper part of the contain means and the side part of the contain means.

9. An image forming apparatus, which has a toner cartridge inserted therein to supplying toner to the image forming apparatus, said apparatus comprising:

a container which contains the toner and provided with a discharging opening for discharging the contained toner, the container having a shape with a predetermined curvature at a bottom part;

a conveying member which conveys the toner in the container to the discharging opening;

an agitating member which rotates centering on a rotational axis in the container, and agitates the toner contained in the container;

a sheet member which is provided on the agitating member and projects in an extended direction from an outer periphery part of the agitating member and has a plurality of cut parts in a direction with intervals in a longitudinal direction, the sheet member having a front edge part which is inclined in an opposite direction with respect to a rotational direction of the agitating member and formed with a part having substantially the same curvature as the bottom part of the container by itself; and a driving unit which drives the agitating member.

10. The image forming apparatus according to claim 9, wherein the sheet member abuts at least one of either the bottom part of the container or a side part of the container.

11. The image forming apparatus according to claim 10, wherein the sheet member elastically changes.

12. The image forming apparatus according to claim 11, wherein the container has a slant face that is formed from an upper part of the container to the side part of a body of the container along a longitudinal direction of the container as the slant face covers a joint of the upper part of the container and the side part of the container.

* * * * *